US007262353B2

(12) United States Patent
Bartholomew et al.

(10) Patent No.: US 7,262,353 B2
(45) Date of Patent: Aug. 28, 2007

(54) BRAIDED COMPOSITE STRINGED INSTRUMENT BOW

(76) Inventors: John Bartholomew, 2101 Las Palmas Dr., Suite B, Carlsbad, CA (US) 92009; Andrew Glasser, 4330 Bullard Ave., Bronx, NY (US) 10466

( * ) Notice: Subject to any disclaimer, the term of this patent is extended or adjusted under 35 U.S.C. 154(b) by 142 days.

(21) Appl. No.: 10/991,316

(22) Filed: Nov. 16, 2004

(65) Prior Publication Data

US 2006/0101981 A1 May 18, 2006

(51) Int. Cl.
*G10F 1/18* (2006.01)

(52) U.S. Cl. ..... 84/282; 84/274; 84/283; 84/325

(58) Field of Classification Search ..... 84/274, 84/282, 283
See application file for complete search history.

(56) References Cited

U.S. PATENT DOCUMENTS

| | | | | | |
|---|---|---|---|---|---|
| 2,252,929 | A | * | 8/1941 | Heddon | 84/282 |
| 2,487,442 | A | | 11/1949 | Hohl | |
| 3,440,918 | A | | 4/1969 | Wurlitser | |
| 3,456,544 | A | * | 7/1969 | Glasser | 84/282 |
| 4,015,501 | A | * | 4/1977 | Schaller | 84/282 |
| 4,657,795 | A | * | 4/1987 | Foret | 280/281.1 |
| 4,754,681 | A | * | 7/1988 | Maigret et al. | 84/282 |
| 4,828,285 | A | * | 5/1989 | Foret et al. | 280/279 |
| 4,860,629 | A | | 8/1989 | Del Giudice | |
| 5,146,835 | A | * | 9/1992 | McConnell et al. | 87/1 |
| 5,203,249 | A | * | 4/1993 | Adams et al. | 87/34 |
| 5,409,651 | A | | 4/1995 | Head | |
| RE35,081 | E | * | 11/1995 | Quigley | 428/36.2 |
| 5,463,970 | A | | 11/1995 | Hartlmeier | |
| 5,575,875 | A | | 11/1996 | Brittingham | |
| 5,979,288 | A | * | 11/1999 | Gallagher et al. | 87/36 |
| 6,036,610 | A | * | 3/2000 | Lewark | 473/564 |
| 6,075,188 | A | * | 6/2000 | Wetzlinger et al. | 84/282 |
| 6,148,865 | A | * | 11/2000 | Head | 138/123 |
| 6,227,094 | B1 | * | 5/2001 | Taylor et al. | 87/9 |
| 6,250,193 | B1 | * | 6/2001 | Head | 87/2 |
| 6,314,856 | B1 | * | 11/2001 | Keith et al. | 87/9 |
| 6,324,833 | B1 | * | 12/2001 | Singer et al. | 60/770 |
| 6,406,659 | B1 | * | 6/2002 | Lang et al. | 264/510 |
| 6,511,462 | B1 | * | 1/2003 | Itou et al. | 604/264 |
| 2006/0101981 | A1 | * | 5/2006 | Bartholomew et al. | 84/325 |

FOREIGN PATENT DOCUMENTS

| | | | | |
|---|---|---|---|---|
| DE | 4014894 | A1 | * | 11/1990 |
| DE | 4014894 | A1 | | 4/1991 |
| EP | 933756 | A2 | | 11/1990 |
| JP | 03287300 | A | * | 12/1991 |
| JP | 2001117558 | A | * | 4/2001 |
| WO | WO9801846 | A1 | * | 1/1998 |

* cited by examiner

*Primary Examiner*—Lincoln Donovan
*Assistant Examiner*—Robert W. Horn

(57) ABSTRACT

A new and improved instrument bow for use with a stringed instrument is provided. A unique new instrument bow is provided that may be constructed with a braided material and/or composite to form the instrument bow. Additionally, the new instrument bow using a braided composite to form a single piece construction instrument bow for use in conjunction with a stringed instrument. The instrument bow may be a combination of a synthetic material covered with a braided material in a single piece construction that will provide the instrument bow with increased resilient and strength without the necessity for reinforcement and/or repair.

18 Claims, 3 Drawing Sheets

BRAIDED COMPOSITE STRINGED INSTRUMENT BOW

FIELD OF THE INVENTION

This invention relates to the field of stringed instruments. More specifically, this invention relates to a bow that is used in conjunction with a stringed instrument. Further, this invention relates to an instrument bow that is composed of a braided composite construction that is flexible yet durable for use with a stringed instrument. Moreover, this invention relates to an instrument bow utilizing a braided composite construction that may be a single unit construction.

BACKGROUND OF THE INVENTION

The bow historically has been a very important part of most stringed instruments, and most stringed instruments would be practically useless without one. Therefore, an understanding of the origin of the bow is important to understand the origin of the related stringed instrument.

The bow as a musical instrument, was well-known among primitive cultures around the world, and throughout the Arab world and the Byzantine Empire, but was not introduced into Western culture until around the eleventh century.

Stringed instruments and the bows used to play these instruments were quite rudimentary, and were subject to considerable variation. The curvature of the stick was also convex, and the hair fastened directly to the stick without a device for adjusting the tension of the hair. These types of bows had to be frequently replaced and/or discarded.

The development of the bow remained rather the same for a considerable time. Certain developments, such as devices to spread the hair were contemplated, but it is not until much later after the introduction of the violin instrument that improvements such as frogs with denotated mechanisms to adjust hair tension, and true button and screw mechanisms were developed.

The familiar pike-type bow head appeared around the time of the death of instrument producer, Stradivari. Common woods used for making bows during this era were iron and snakewood; lighter woods were often fluted to give the bow additional strength and rigidity.

For a long period of time, the curvature, or camber of the bow, remained convex. Perhaps as a result of experimentation and artistic collaboration, the camber was changed from convex to concave, the fluted bow and pike's head abandoned, and the ferrule invented.

During this period, the bow changed considerably as a result of changes in performance venues, as music moved from the smaller stages to larger venues and larger audiences. The newer bows enabled greater sonority, power, and projection, sustained a wider range of dynamic levels, and articulated a greater variety of new bowing techniques.

Pernambuco wood became the wood of choice for string instrument bows because pernambuco wood is extremely heavy and dense. Pernambuco also was an important source in dye manufacturing before the advent of synthetic aniline dyes. The ready availability of tremendous quantities of pernambuco wood eventually changed the construction of the bow because of pernambuco's combination of strength and elasticity for making bows.

Modern producers of bows have attempted to make the bow out of a composite material including fiberglass and plastics. However, the sound qualities and the construction necessary to make these bows have been problematic and have led most users to stick with the wood designs.

A problem with the standard type instrument bows is that they are made up of a plurality of pieces that must be fitted together to form the unit. Because the instrument bow is constructed in a plurality of pieces that are subsequently affixed to each other, they tend to come apart after substantial use and must be either fixed or discarded.

Yet another problem exists because the typical instrument bow must be constantly adjusted and requires a considerable amount of upkeep to keep the bow in condition for use.

What is needed is a improved instrument bow and technique for making the improved instrument bow. Further, a need therefore exists for an improved instrument bow that may use more modern materials that may be cheaper and easy to form. Moreover, a need exists for an instrument bow that is a single piece construction that does not need frequent repair and/or adjustment yet has good sound quality and utility.

SUMMARY OF THE INVENTION

The present invention provides a new instrument bow for use with a stringed instrument. More specifically, the present invention provides a new instrument bow that may be constructed with a braided composite to form the instrument bow. Additionally, the present invention provides a new instrument bow using a braided composite to form a single piece construction instrument bow for use in conjunction with a stringed instrument. The present invention also provides a instrument bow that is resilient and does not need constant reinforcement and/or repair.

To this end, in an embodiment of the present invention a instrument bow is provided. The instrument bow may have a frog portion wherein said frog portion is positioned at one end of the instrument bow. The instrument bow may also have a shaft portion and a head portion positioned at a second end of the instrument bow wherein said head portion is connected to said shaft which in turn is connected to said frog portion. Moreover, the instrument bow may have a frog portion, shaft portion and a head portion forming a single piece unit covered by a braided material.

In an embodiment, the instrument bow has a frog portion, a shaft and a head portion being connected to each other in a seamless fashion.

In an embodiment the instrument bow has a horsehair portion detachably connected to said head portion and extending away from said head portion and detachably connected to said frog portion.

In an embodiment, the instrument bow is provided wherein said shaft portion and said head portion which are covered by a braided material wherein said braided material is wrapped helically, the shaft and the head portion.

In an embodiment, the instrument bow has a frog portion, a shaft portion and said head portion comprising a solid core of polyurethane foam and being wrapped with unidirectional carbon fibers running along its longitudinal axis.

In an embodiment, the instrument bow has a shaft portion and a head portion comprising a solid core of polyurethane foam and being wrapped with unidirectional carbon fibers running along its longitudinal axis wherein said core is run through a braider that wraps a plurality of fibers helically about the core.

In an embodiment, the instrument bow has a core that may be run through a braider that wraps a plurality of fibers helically about the core wherein said fibers are carbon.

In an embodiment, the instrument bow has a core that may be run through a braider that wraps a plurality of fibers helically about the core wherein said fibers are carbon, fiberglass, aramid, kevlar®, vectran® or Spectra®.

In an embodiment, the instrument bow has a frog portion, a shaft portion and a head portion wherein the frog portion, the shaft portion and the head portion are formed as a single unit covered with a braided material and further wherein the single unit covered with a braided material are infused with resin.

In an embodiment, an instrument bow is provided. The instrument bow may have a frog portion said frog portion being positioned at one end of the instrument bow. The instrument bow may also have a shaft portion and a head portion positioned at a second end of the instrument bow wherein said head portion is connected to said shaft which in turn is connected to said frog portion by way of horse hair. Moreover, the instrument bow may also have a shaft portion and a head portion forming a single piece unit. Still further, the instrument bow may have a braided material encompassing said single piece unit wherein said braided material covers the whole single piece unit and it comprised of a plurality of fibers.

In an embodiment, the instrument bow may have a braided material having a plurality of fibers wrapped helically about the said single piece unit.

In an embodiment, the instrument bow may have a horsehair portion detachably connected to said head portion and extending away from said head portion and detachably connected to said frog portion.

In an embodiment, the instrument bow may have a frog portion, a shaft portion and a head portion are comprised of a solid core of polyurethane foam wrapped with unidirectional carbon fibers running along its longitudinal axis.

In an embodiment of the present invention, a method of fabricating an instrument bow is provided. The method comprising the steps of: providing a solid core of a synthetic material wherein said solid core includes a head portion, and a shaft portion injecting said synthetic material into a mold to produce a single piece instrument bow piece; inserting said core through a braider that wraps the core with a braided material and producing a preform of said core covered by said braided material.

In an embodiment, the method of fabricating an instrument bow includes the further step of: inserting the core through a braider that wraps the core with a braided material wherein said braided material comprising a plurality of fibers helically wound about the core.

In an embodiment, the method of fabricating an instrument bow includes the further step of: placing the preform into a mold and closing the mold about the preform.

In an embodiment, the method of fabricating an instrument bow includes the further step of: utilizing a resin transferee molding to infuse resin into the mold when the mold is closed.

In an embodiment, the method of fabricating an instrument bow includes the further step of: heating the mold to facilitate curing of the resin to the preform; and removing the mold from the oven, cooling the mold and removing the instrument bow from the mold.

It is, therefore, an advantage of the present invention to provide a unique instrument bow and a method of making the same.

Another advantage of the present invention is to provide a new instrument bow and a method of making the same that may be used with a variety of different musical instruments.

Still another advantage of the present invention is to provide a new instrument bow and a method of making the same that may be used in conjunction with a stringed instrument.

Yet another advantage of the present invention is to provide a new instrument bow and a method of making the same that may be used to play a violin.

Another advantage of the present invention is to provide a new instrument bow and a method of making the same wherein the instrument bow may be made of plastic.

Still another advantage of the present invention is to provide a new instrument bow and a method of making the same wherein the instrument bow may be made of wood.

An advantage of the present invention is to provide a new instrument bow and a method of making the same wherein the instrument bow may be made of a substantially rigid material.

Yet another advantage of the present invention is to provide a new instrument bow and a method of making the same wherein the instrument bow may be made of a flexible material.

Still another advantage of the present invention is to provide a new instrument bow and a method of making the same wherein the instrument bow may be made quickly from a mold.

Another advantage of the present invention is to provide a new instrument bow and a method of making the same wherein the instrument bow may be fabricated in a mold and wherein the mold may allow the core to be hollow.

Yet another advantage of the present invention is to provide a new instrument bow and a method of making the same wherein the instrument bow may be fabricated in a mold and wherein the mold may allow the core to be hollow and further wherein the core may be infused with resin.

An advantage of the present invention is to provide a new instrument bow and a method of making the same wherein the instrument bow may be fabricated using a resin infusion process.

Still another advantage of the present invention is to provide a new instrument bow and a method of making the same wherein the instrument bow may use a braided material thereon.

Yet another advantage of the present invention is to provide a new instrument bow and a method of making the same wherein the instrument bow may use a braided material thereon wherein said braided material may be utilized in combination with a number of other materials to fabricate the instrument bow.

Still another advantage of the present invention is to provide a new instrument bow and a method of making the same wherein the instrument bow may have a core made of a material that may be surrounded by braided material.

Another advantage of the present invention is to provide a new instrument bow and a method of making the same wherein the instrument bow may have a braided material that is braided around a core in a seamless fashion.

A further advantage of the present invention is to provide a new instrument bow and a method of making the same wherein the instrument bow may use braided material in combination with fiberglass to form the bow.

Yet another advantage of the present invention is to provide a new instrument bow and a method of making the same wherein the instrument bow may use braided material in combination with a carbon fiber to form a bow.

Still another advantage of the present invention is to provide a new instrument bow and a method of making the same wherein the instrument bow may use braided material in combination with a composite material to form a bow.

An advantage of the present invention is to provide a new instrument bow and a method of making the same wherein the instrument bow may use braided material in combination with titanium wire to form a bow.

Yet another advantage of the present invention is to provide a new instrument bow and a method of making the same wherein the instrument bow may use a braided material in combination with brass wire to form a bow.

Another advantage of the present invention is to provide a new instrument bow and a method of making the same wherein the instrument bow may use a braided material in combination with gold wire to form a bow.

Still another advantage of the present invention is to provide a new instrument bow and a method of making the same wherein the instrument bow may use a braided material in combination with Vectran, Spectra, Kevlar, and/or any polyester to form a bow.

An advantage of the present invention is to provide a new instrument bow and a method of making the same wherein the construction of the instrument bow may be by resin infusion.

Yet another advantage of the present invention is to provide a new instrument bow and a method of making the same wherein the construction of the instrument bow may be by resin infusion wherein the resin infusion process may allow for placement of an un-impregnated part into a mold formed in the shape of the instrument bow.

Still another advantage of the present invention is to provide a new instrument bow and a method of making the same wherein the construction of the instrument bow may be by resin infusion wherein the resin infusion process may allow for placement of an un-impregnated part into a mold formed in the shape of the instrument bow and further wherein the process may allow infusion of resin, curing the bow and removing the finished product from the mold.

Another advantage of the present invention is to provide a new instrument bow and a method of making the same wherein the instrument bow may be made of hand impregnated resin.

A further advantage of the present invention is to provide a new instrument bow and a method of making the same wherein the instrument bow may be made of a machine impregnated thermosetting resin.

Still another advantage of the present invention is to provide a new instrument bow and a method of making the same wherein the instrument bow may be composed of an impregnated material that is rolled and cured to shape.

Yet another advantage of the present invention is to provide a new instrument bow and a method of making the same wherein the instrument bow may be composed of an impregnated material that may be laid into molds and cured to shape.

Still another advantage of the present invention is to provide a new instrument bow and a method of making the same wherein the instrument bow may be composed of a plurality of materials to form the bow.

Yet another advantage of the present invention is to provide a new instrument bow and a method of making the same wherein the instrument bow may be flexible during use.

An advantage of the present invention is to provide a new instrument bow and a method of making the same wherein the instrument bow may be rigid.

Another advantage of the present invention is to provide a new instrument bow and a method of making the same wherein the instrument bow may be a single piece construction.

A further advantage of the present invention is to provide a new instrument bow and a method of making the same wherein the instrument bow may be a single piece construction wherein the head of the bow and the shaft of the bow are formed together and are not detachably releasable from each other.

Yet another advantage of the present invention is to provide a new instrument bow and a method of making the same wherein the instrument bow may be a single piece construction wherein the entire bow is covered with a braided material.

Still another advantage of the present invention is to provide a new instrument bow and a method of making the same wherein the instrument bow may be a single piece construction wherein the entire bow may be covered with a braided material wherein the braided material strengthens the entire bow.

Still another advantage of the present invention is to provide a new instrument bow and a method of making the same wherein the instrument bow may be made of a plurality of pieces which are formed together and may be detachably released from each other allowing for the parts of the bow including the head, the frog and the shaft to be replaced with other bow pieces.

An advantage of the present invention is to provide a new instrument bow and a method of making the same wherein the instrument bow may be constructed with a plurality of pieces that are attached and covered with a braided material and a resin infusion.

Yet another advantage of the present invention is to provide a new instrument bow and a method of making the same wherein the instrument bow may be formed as a single piece unit in a mold.

Still another advantage of the present invention is a new instrument bow and a method of making the same wherein the instrument bow provides good quality sound.

Another advantage of the present invention is a new instrument bow and a method of making the same wherein the instrument bow may last longer than conventional prior art instrument bows.

Another advantage of the present invention is to provide a new instrument bow and a method of making the same wherein the instrument bow may retain conventional prior art design for a instrument bow.

Still another advantage of the present invention is to provide a new instrument bow and a method of making the same wherein the instrument bow may have a braided material thereon which may increase the strength and durability of the instrument bow.

These and other objects of the invention will become more clear when one reads the following specification, taken together with the drawings that are attached hereto.

The scope of protection sought by the inventors may be gleaned from a fair reading of the Claims that conclude this specification.

Additional features and advantages of the present invention are described in, and will be apparent from, the detailed description of the presently preferred embodiments and from the drawings.

DESCRIPTION OF THE PREFERRED EMBODIMENT

Figure 1:
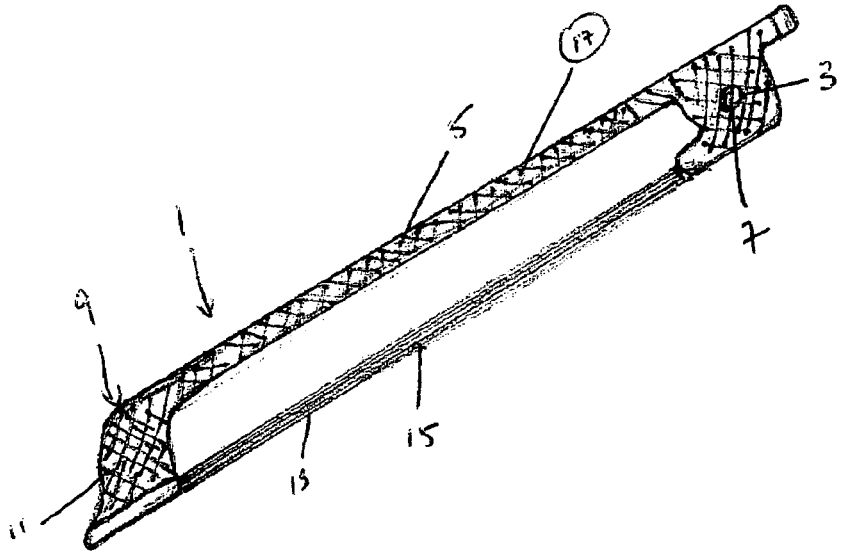
FIG. 1 is a perspective view of the instrument bow in an embodiment of the present invention.

Turning now to the drawings wherein elements are identified by numbers and like elements are identified by like numbers throughout the 5 figures, the invention is depicted in FIG. 1 that shows a instrument bow 1.

The instrument bow 1 may have a plurality of corresponding connecting parts that form the whole of the bow 1. The bow 1 may have a frog 3. The frog 3 may be the back of the bow 1 where a user (not shown) may hold the bow 1 to use with association with a musical instrument (not shown). The frog 3 may be connected to the shaft 5 of the instrument bow 1. The frog 3 of the bow 1 may have an eye 7. The eye 7 of the bow 1 may be contained anywhere on the frog 3. In a preferred embodiment of the present invention, the eye 7 may be positioned in the middle of the frog 3 of the instrument bow 1. In an embodiment, the eye 7 may be silver. In another embodiment, the eye 7 may be nickel. However, as can be appreciated, the eye 7 may be of any suitable material for functional or aesthetic purposes. FIG. 1 also illustrates the shaft 5 of the instrument bow 1. The shaft 5 may have a curvature from the back and/or frog 3 of the bow 1 to the front 9 of the bow 1. The front 9 of the bow 1 may be configured to have a head 11. The head 11 of the instrument bow 1 is connected to the shaft 5 of the bow 1 which in turn is connected to the frog 3 of the instrument bow 1.

As further illustrated in FIG. 1, the head 11 of the bow 1 may be connected to the frog 3 of the instrument bow 1 by a hair means 13. The hair means 13 may be connected to the head 11 and pulled toward the frog 3 and ultimately connected to the frog 3 of the instrument bow 1. In an embodiment, a plurality of horse hair 15 may be used to construct the entirety of the hair means 13. However, the hair means 13 may be any material that may be connected to the frog 3 and the head 11 simultaneously and yet able to produce the desired effect of playing a stringed instrument (not shown).

Moreover, FIG. 1 illustrates an instrument bow 1 that may be a composite structured instrument bow 1. The composition structure may be made of a composite material that may allow for a resilient construction, yet may provide excellent strength, stiffness and consistency for a longer period than prior art instrument bows. The composite instrument bow 1 may utilize a braided material 17 that may be placed onto a molded composite bow 1 and may be infused with resin to form the braided pattern 17 on the instrument bow 1. In a preferred embodiment, the braided material 17 may be used on the entire structure of the instrument bow 1, wherein the braided material 17 would encapsulate the entire composite material making up the bow 1, forming a single piece bow 1. The advantage of a single piece and/or unit instrument bow 1 may be that the single piece and/or unit instrument bow 1 may not have the characteristics of prior art bows wherein the prior art bows need frequent repairs and/or alterations to keep them in good repair. A single piece unit may be more resilient, stiffer, and/or stronger than the prior art instrument bows.

Figure 2:
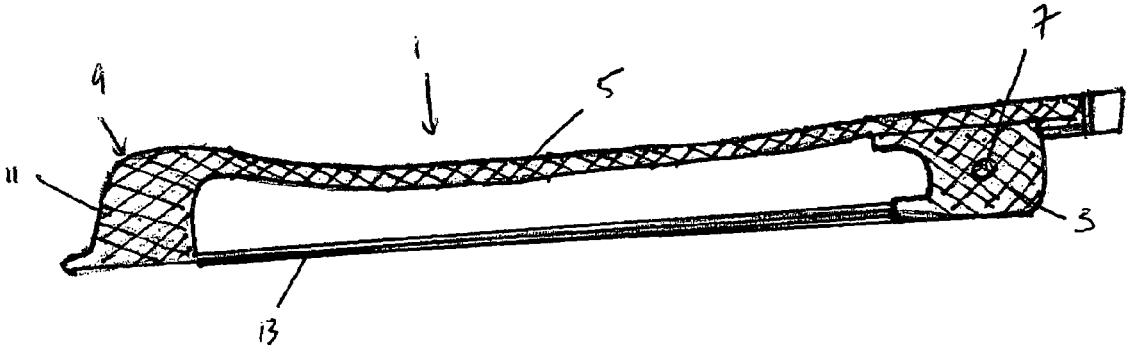
FIG. 2 is a side view of the of the instrument bow in an embodiment of the present invention.
Figure 3:
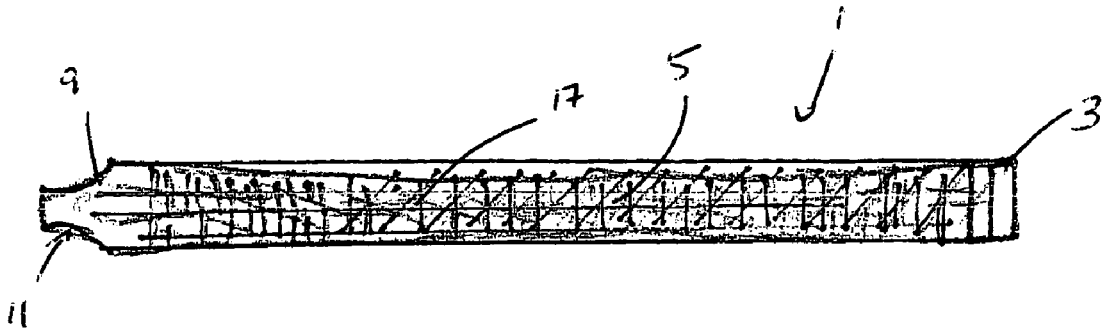
FIG. 3 is a top view of the instrument bow in an embodiment of the present invention.

FIG. 2 illustrates a side view of the instrument bow 1 showing the single piece construction of the instrument bow 1. Moreover, FIG. 2 illustrates the braided material 17 covering a composite material 21 (see FIG. 4, 21) that may be used to construct the instrument bow 1. Any composition material 21 may be used to construct the instrument bow 1. In a preferred embodiment, the composite material 21 may be carbon fiber and/or fiberglass. However, the composite material 21 used to form the instrument bow 1 may use a plurality of materials including, but not limited to: titanium wire, brass wire, gold wire, Vectran®, Spectra®, Kevlar®, polyester, or a plurality of other materials suitable for constructing an instrument bow 1.

Figure 4:
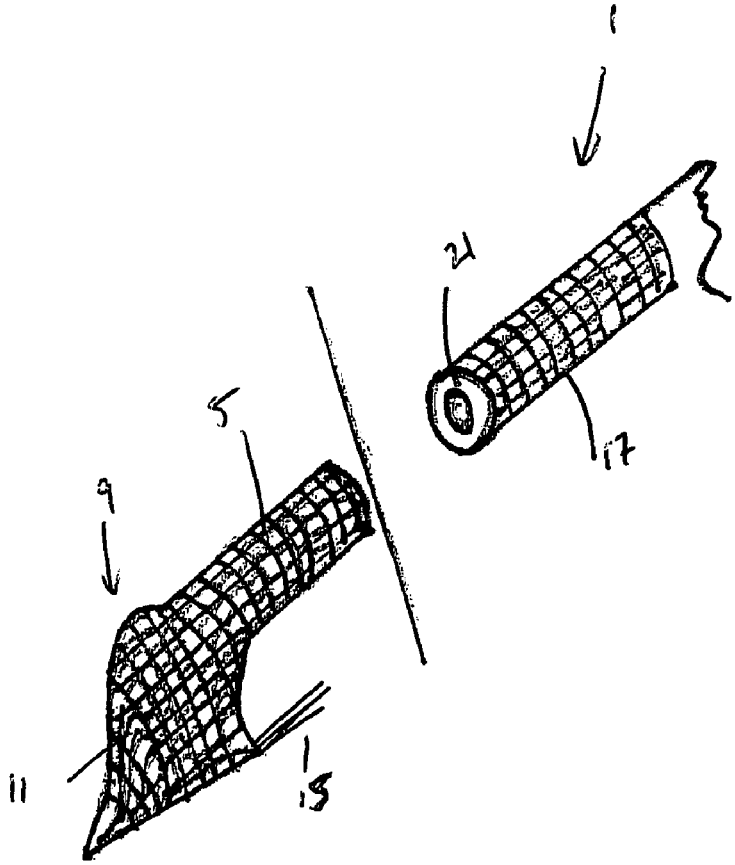
FIG. 4 is a cross sectional perspective view of the instrument bow in an embodiment of the present invention.

As illustrated in FIG. 2 and FIG. 4, the braided material 17 may be used to cover a composite 21 and/or other material. The composite 21 and/or other material may be first fabricated either by hand, or by the formation of a mold. The fabricated composite material 17 may then be covered by a braided material 17 and that may subsequently be placed into a mold and infused with a substance to hold the braided material 17 over the composite material 21. The braided material 17 and the composite material 21 may then form a single piece instrument bow 1 for use with a variety of preferably stringed instruments, including the violin, the cello, and other stringed instruments.

FIG. 4 also illustrates a cross-section view of the instrument bow 1. The composite material 21 may be fabricated and covered with the braided material 17. The braided material 17 is placed onto the composite material 21 wherein the subsequent composite material 21 and braided material 17 composition may be set into a cavity (not shown). The complete bow 1 including the composite material 21 and braided material 17 may be infused with resin to strengthen the composition and provide better resiliency, stiffness and consistency for a long period of time.

Figure 5:
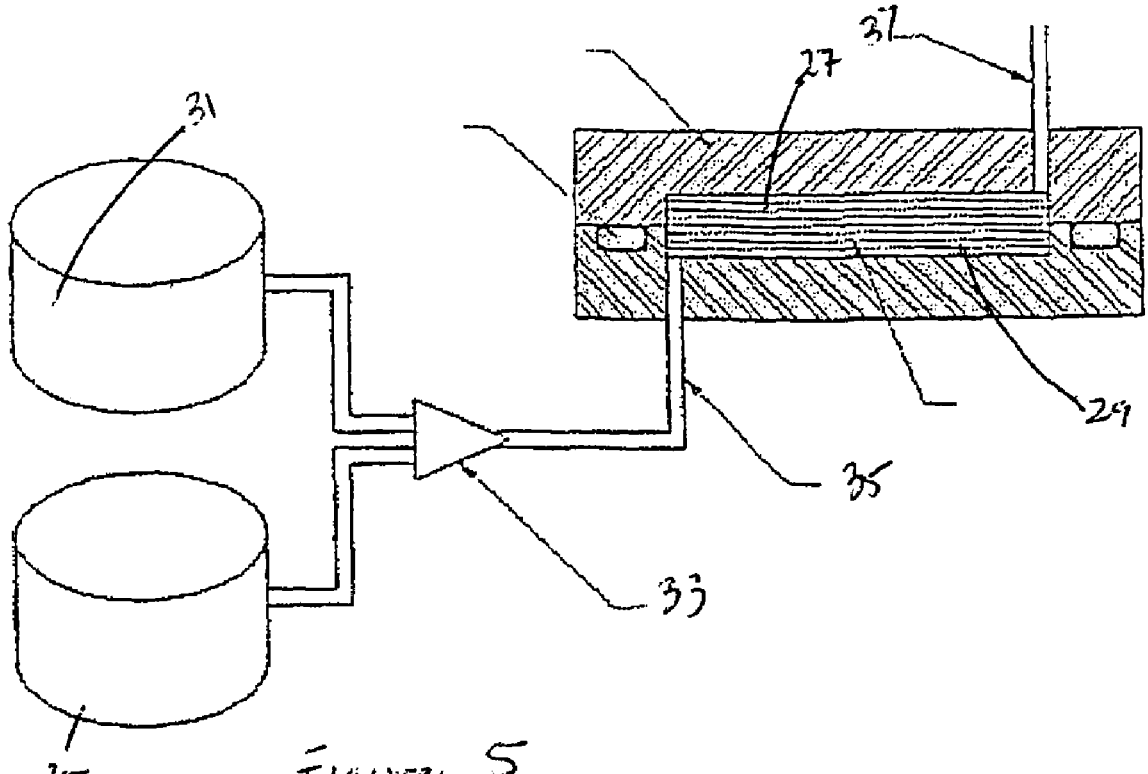
FIG. 5 is a schematic of the process to make the instrument bow in an embodiment of the present invention.

FIG. 5 illustrates the process of manufacturing the braided composite bow 1. In a preferred embodiment, a solid core of a polyurethane foam may be wrapped with unidirectional carbon fibers running along its longitudinal axis. The core with attached fibers may then be run through a braider that may wrap a plurality of fibers helically. The preform may then be placed into a mold 29 and the mold 29 is subsequently closed about the preformed instrument bow 1. The process of resin transferee molding the cavity may be used to infuse the preform with uncured resin 25 which may include epoxy, vinyl ester, polyester or any other uncured resin 25. The resin may be mixed with a hardener 31 and sent through a mixing head 33. The resin 25 and the hardener 31 may be sent through the mixing head 33 and discharged into the mold/cavity 29 that may hold the braided instrument bow 1. The resin 25 and the hardener 31 may be inserted into the mold/cavity 29 by the use of a inlet head 35, and the excess resin and hardener may be disposed of with an outlet and/or vent 37. In a preferred embodiment, the instrument bow 1 may be placed in a heating means 27 to cure the resin 25 to the instrument bow 1 composite. After heating the part may be removed from the heating means 25, cooled and taken out of the mold/cavity 27. While the above identified process is the preferred embodiment of fabricating the composite bow, it should be understood that many minor modifications may be undertaken to complete the same process by a slightly different means, without departing from the essential process of infusion of resin 25 and hardener 31 over a braided preform of an instrument bow 1.

It should be understood, however, that modifications to the presently preferred embodiments described herein will be apparent to those skilled in the art. Such changes and modifications may be made without departing from the spirit and scope of the present invention and without diminishing its attendant advantages.

What is claimed is:

1. A instrument bow comprising:

a frog portion said frog portion being positioned at one end of the instrument bow;

a shaft portion;

a head portion positioned at a second end of the instrument bow wherein said head portion is connected to said shaft portion which in turn is connected to said frog portion by way of hair means;

said shaft portion, frog portion and said head portion forming a single piece unit covered by a braided material wherein the entire shaft portion, frog portion and head portion is covered by the braided material in a unitary fashion.

2. The instrument bow of claim 1, further comprising:

the frog portion, said shaft portion and said head portion being connected to each other in a seamless fashion.

3. The instrument bow of claim 1, further comprising:

a horsehair portion detachably connected to said head portion and extending away from said head portion and detachably connected to said frog portion.

4. The instrument bow of claim 1 wherein said shaft portion and said head portion are covered by a braided material wherein said braided material is wrapped helically about the shaft portion and the head portion.

5. The instrument bow of claim 1 farther comprising:

said frog portion, said shaft portion and said head portion comprising a solid core of polyurethane foam and being wrapped with unidirectional carbon fibers running along its longitudinal axis.

6. The instrument bow of claim 1 further comprising:

said shaft portion and said head portion comprising a solid core of polyurethane foam and being wrapped with unidirectional carbon fibers running along its longitudinal axis wherein said core is run through a braider that wraps a plurality of fibers helically about the core.

7. The instrument bow of claim 6 wherein said core is run through a braider that wraps a plurality of fibers helically about the core wherein said fibers are carbon.

8. The instrument bow of claim 6 wherein said core is run through a braider that wraps a plurality of fibers helically about the core wherein said fibers are carbon, fiberglass, aramid, aromatic polyester, or an ultra high molecular weight polyethylene.

9. The instrument bow of claim 1 wherein the shaft portion and the head portion are formed as a single unit covered with a braided material and further wherein the single unit covered with a braided material are infused with resin.

10. The instrument bow comprising:

a frog portion said frog portion being positioned at one end of the instrument bow;

a shaft portion;

a head portion positioned at a second end of the instrument bow wherein said head portion is connected to said shaft portion which in turn is connected to said frog portion by way of hair means;

said shaft portion and said head portion forming a single piece unit;

a braided material encompassing said single piece unit wherein said braided material covers the whole single piece unit and it comprised of a plurality of fibers and further wherein the braided material encompasses the frog portion in addition to the single piece unit of the shaft portion and the head portion.

11. The instrument bow of claim 10 further comprising:

said braided material having a plurality of fibers wrapped helically about the said single piece unit.

12. The instrument bow of claim 10 further comprising:

a horsehair portion detachably connected to said head portion and extending away from said head portion and detachably connected to said frog portion.

13. The instrument bow of claim 10 wherein said shaft portion and said head portion are comprised of a solid core of polyurethane foam wrapped with unidirectional carbon fibers running along its longitudinal axis.

14. A method of fabricating an instrument bow, said method comprising the steps of:

providing a solid core of a synthetic material wherein said solid core includes a head portion, a shaft portion and a frog portion;

injecting said synthetic material into a mold to produce a single piece instrument bow piece;

inserting said core through a braider that wraps the core with a braided material and producing a preform of said core covered by said braided material.

15. The method of claim 14 further comprising the step of:

inserting the core through a braider that wraps the core with a braided material wherein said braided material comprising a plurality of fibers helically wound about the core.

16. The method of claim 14 further comprising the step of:

placing the preform into a mold and closing the mold about the preform.

17. The method of claim 16 further comprising the step of:

utilizing a resin transferee molding to infuse resin into the mold when the mold is closed.

18. The method of claim 17 further comprising the step of:

heating the mold to facilitate curing of the resin to the preform; and removing the mold from the oven, cooling the mold and removing the instrument bow from the mold.

* * * * *